US006964553B2

(12) United States Patent
Ricordi

(10) Patent No.: US 6,964,553 B2
(45) Date of Patent: Nov. 15, 2005

(54) PORT FOR A FAN CHAMBER

(75) Inventor: Christian Paul Andre Ricordi, Bourg-les-Valence (FR)

(73) Assignee: Illinois Tool Works Inc., Glenview, IL (US)

( * ) Notice: Subject to any disclaimer, the term of this patent is extended or adjusted under 35 U.S.C. 154(b) by 40 days.

(21) Appl. No.: 10/444,850

(22) Filed: May 23, 2003

(65) Prior Publication Data

US 2004/0232193 A1 Nov. 25, 2004

(51) Int. Cl.[7] ..... F01B 25/02

(52) U.S. Cl. ..... 415/146; 415/46; 415/211.2; 415/220; 415/225; 415/26; 227/8; 227/10; 227/130; 123/46 SC; 123/46 R

(58) Field of Search ..... 227/8, 10, 130; 123/46 SC, 46 R; 415/26, 46, 146, 211.2, 220, 225

(56) References Cited

U.S. PATENT DOCUMENTS 4,483,474 A * 11/1984 Nikolich ..... 227/8
4,773,581 A * 9/1988 Ohtsu et al. ..... 227/10
5,090,606 A 2/1992 Torii et al.
5,197,646 A * 3/1993 Nikolich ..... 227/8
5,873,508 A * 2/1999 MacVicar et al. ..... 227/10
5,897,043 A * 4/1999 Veoukas et al. ..... 227/10
5,988,477 A * 11/1999 Deieso et al. ..... 227/130
6,247,626 B1 * 6/2001 MacVicar ..... 227/10
6,260,519 B1 * 7/2001 Phillips ..... 123/46 SC
6,318,615 B1 * 11/2001 Walter ..... 227/10
6,460,507 B2 * 10/2002 Thieleke et al. ..... 123/46 R
6,463,894 B2 * 10/2002 Hasler et al. ..... 123/46 R
6,526,926 B1 3/2003 Towfighi
6,584,945 B2 * 7/2003 Porth ..... 123/46 SC
6,619,527 B1 * 9/2003 Moeller ..... 227/10
6,779,493 B2 * 8/2004 Doherty et al. ..... 227/10
2002/0134069 A1 9/2002 Adams
2002/0134345 A1 9/2002 Adams
2002/0144498 A1 10/2002 Adams

FOREIGN PATENT DOCUMENTS

DE 199 62 697 6/2001

* cited by examiner

*Primary Examiner*—John Sipos
*Assistant Examiner*—Michelle Lopez
(74) *Attorney, Agent, or Firm*—Lisa M. Soltis; Mark W. Croll; Josh C. Snider

(57) ABSTRACT

A port is employed for a fan chamber which defines a volume formed by at least one generally continuous vertical wall connecting a horizontal base wall with an opposing horizontal exit wall. Within the volume is a fan rotatable in a plane generally parallel to a plane of at least one of the horizontal walls. The port is formed of an inner side located between a center of the exit wall and an outer edge of said the wall, an outer side located between the inner side and the outer edge of the exit wall, and two opposing secant sides connecting respective ends of the outer side to the inner side. A shape of the inner side forms a straight line or a convex line with respect to the center of the exit wall.

6 Claims, 4 Drawing Sheets

PRIOR ART

FIG. 2 PRIOR ART
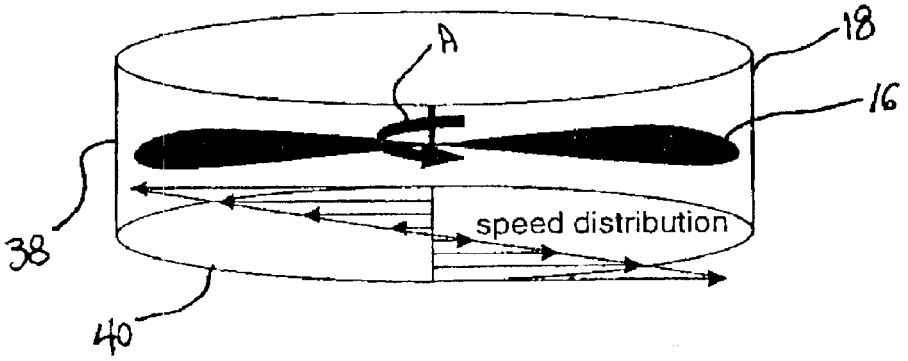
FIG. 3
PRIOR ART
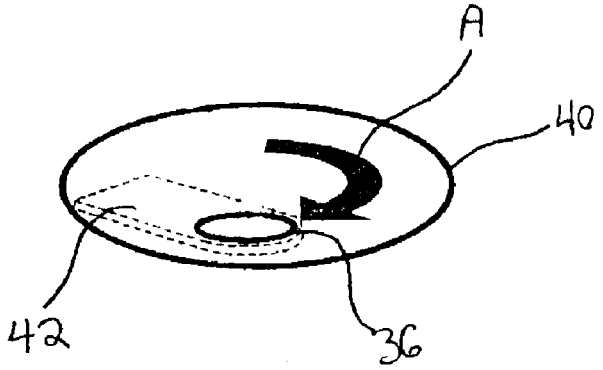
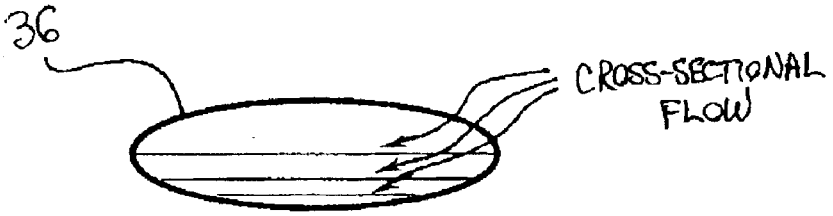
FIG. 4
PRIOR ART

PORT FOR A FAN CHAMBER

BACKGROUND OF THE INVENTION

The present invention relates to a port for a fan chamber, and more specifically to combustion-powered fastener driving tools utilizing a fan chamber having a port through which pressured gases from a chamber volume are expelled to an outside volume of lower pressure.

Gas combustion devices are known in the art. A practical application of this technology is found in combustion-powered fastener driving tools. One type of such tools, also known as IMPULSE® brand tools for use in driving fasteners into workpieces, is described in commonly assigned patents to Nikolich U.S. Pat. Re. No. 32,452, and U.S. Pat. Nos. 4,522,162, 4,483,473, 4,483,474, 4,403,722, 5,197,646 and 5,263,439, all of which are incorporated by reference herein. Similar combustion powered nail and staple driving tools are available commercially from ITW-Paslode of Vernon Hills, Ill. under the IMPULSE® brand, and from ITW-S.P.I.T. of Bourg-les-Valence, France under the PULSA® brand.

A known combustion-powered fastener driving tool is shown in FIG. 1. The tool 10 incorporates a generally pistol-shaped tool housing 12 enclosing a small internal combustion engine 14. The engine is powered by a canister of pressurized fuel gas (not shown), also called a fuel cell. A battery-powered electronic power distribution unit (not shown) produces a spark for ignition, and a fan 16 located in a combustion chamber 18 provides for both an efficient combustion within the chamber 18, while facilitating processes ancillary to the combustion operation of the device.

Such ancillary processes include: inserting fuel into the chamber 18; mixing the fuel and air within the chamber 18; and removing, or scavenging, combustion by-products. In addition to these ancillary processes, the fan further serves to cool the tool and increase combustion energy output. The engine 14 includes a reciprocating piston 20 with an elongated, rigid driver blade 22 disposed within a single cylinder body 24.

A valve sleeve 26 is axially reciprocable about the cylinder body 24 and, through a linkage (not shown), moves to close the combustion chamber 14 when a work contact element 28 at the end of the linkage is pressed against a workpiece 30. This pressing action also triggers a fuel-metering valve (not shown) to introduce a specified volume of fuel into the closed combustion chamber 18.

Upon the pulling of a trigger switch 32, which causes a spark to ignite a charge of gas in the combustion chamber 18 of the engine 14, the piston 20 and driver blade 22 are shot downward to impact a positioned fastener (not shown) and drive the fastener into the workpiece 30. The piston 20 then returns to its original, or "ready" position, through differential gas pressures within the cylinder body 24. Fasteners are fed magazine-style into a nosepiece 34, where the fasteners are held in a properly positioned orientation for receiving the impact of the driver blade 22.

Upon ignition of the combustible fuel/air gas mixture, the combustion in the chamber 18 transfers the ignited gas through a port 36 in the chamber 18, which causes the acceleration of the piston/driver blade assembly 20/22 and the penetration of the fastener into the workpiece 30, if the fastener is present in the nosepiece 34. Combustion pressure in the chamber 18 is an important consideration because the pressure affects the amount of force with which the piston 20 may drive the fastener. Other important considerations are the amount of time required to drive the piston by the ignited gas sent through the port 36, and to complete the ancillary processes between combustion cycles of the engine.

During combustion, a significant amount of gas needs to be transferred from the combustion chamber 18 to the cylinder body 24 within a short time. The fan 16 accelerates this process by its rotation. Efficiency of the fan 16 is significantly affected by the way the chamber 18 and the cylinder body 24 are designed and connected. The fan 16 also serves several other functions. The fan 16 mixes air and fuel, purges exhaust gases, cools the tool 10, and also increases combustion energy output.

Referring now to FIGS. 2 through 4, the effects of the rotation of the fan 16 in the chamber 18 is illustrated. As the fan 16 rotates, a swirl is generated in the chamber 18 in the direction A. The speed of the swirl is equal to zero at the center of rotation, and is maximized nearest an outer wall 38 of the chamber 18. The chamber 18 is typically shaped as a cylinder to maximize the efficiency of the swirl in a circular direction. The change in the speed distribution of the swirl, from the center of rotation to the outer wall 38, generally can be considered to increase linearly, and as a function of a radius of a circular cross-section of the cylindrical wall 38 of the chamber 18, as best seen in FIG. 2.

The swirling flow is transferred out of the chamber 18 through the port 36, located on a disk-shaped top plate 40 joining the outer wall 38. The plate 40 has at least one port. In order to quickly transfer a significant amount of gas through the port 36, the port is made as large as possible, and positioned away from the center of the plate 40, and toward the outer wall 38, where the speed of the swirl is greatest. The central region of the plate 40 is often solid, and can serve as a convenient location for mounting a valve and limiter combination 42, as best seen in FIG. 3 shown in relief.

The shape of the port 36 and valve/limiter 42 determines the resulting cross-sectional flow distribution of gas through the port 36. The present inventor has discovered that, when the port 36 is circular, the resulting cross-sectional flow is elliptical, and inconsistent across and through the port 36, as best seen in FIG. 4. This inconsistency can make the flow of gas through the port 36 unstable, and can thus quench the flame of an ignited gas traveling through the port. Although this quenching is undesirable, it may still be possible to transfer sufficient pressure from the ignited gas in the chamber 18 to fully accelerate the driver blade 22, even if the gas contacting the piston 20 is no longer ignited. Higher energy combustion, however, can be realized by avoiding flame quenching.

There are several significant disadvantages to using a circular port in combustion chambers of this type. A circular port fails to utilize the natural speed distribution of the flow generated by the fan 16. As discussed above, the speed distribution of the flow is considered to increase linearly away from the center of rotation. A circular port will by definition, however, always have one half of its area decreasing away from the center of rotation. Accordingly, the linear area of the circular port 36 farthest away from the center of rotation approaches zero where the speed distribution of the flow is greatest. The circular port 36 therefore fails to allow through it the flow of gas having the greatest energy, which is also an undesirable result.

Multiple combustion chamber systems are utilized in similar tool configurations in order to extract more energy from the combustion. One such preferred system is described in a copending, commonly assigned U.S. Patent Application Ser. No. 10/170,736, which is also incorporated by reference herein. When more than one chamber is used with only one fan, fan efficiency is similarly affected by the way the multiple chambers are designed and connected.

In such a multiple-chamber configuration, the highest output of gas flow through the port is reached by creating a restrictive path for the gas to travel from one chamber to the other. The restrictive path is accomplished by a combination of valves, limiters, ports, and shrouds. The port connecting two chambers typically includes a reed valve, which remains normally closed to prevent back flow of pressure from the second chamber into the first chamber. A limiter physically restricts how far the moving gas may open the valve.

In a tool of this type having a circular port, however, utilizing a more restrictive path to extract more combustion power can in turn negatively affect the tool's ability to transfer gas properly from one chamber to the next during an early stage of combustion. Additionally, when using shrouds, ports, valves, and valve limiters to connect chambers in a multiple-volume combustion chamber with a fan, the operating environment of the system that allows a stable performance becomes significantly narrower. This increased likelihood of instability also increases the likelihood that the flame of the ignited gas passing from one chamber to the next through the restrictive path will be quenched.

Flame quenching in a multiple-chamber configuration can be a significant problem. Pressure build-up from the ignited gas in one chamber can be largely absorbed by the gas in the next chamber when the gas flowing from the first chamber fails to ignite the gas in the next chamber. In other words, gas pressure reaching a piston after the flame is quenched will be less than the pressure from the airflow entering the chamber contacting the piston. The loss in pressure to drive a piston caused by flame quenching becomes even more pronounced as the number of chambers increases.

The instability of the flow through the restrictive path also can decrease the useful lifetime of a valve used in the path. Also, the complexity of the configuration, as well as the number of its required components, both undesirably increase as the airflow path between chambers becomes more restrictive and complex. Accordingly, it is desirable to have an improved configuration which overcomes the above-listed problems.

SUMMARY OF THE INVENTION

The above-listed problems are addressed by the present port for a fan chamber. The fan chamber features a solid chamber structure, preferably containing a combustible gas. A fan in the chamber acts to swirl the gas in the chamber, and create a turbulence which enables the gas to move more rapidly across and through the port.

More specifically, the present invention provides a port for a fan chamber made of a volume formed of at least one generally continuous vertical wall connecting a horizontal base wall with an opposing horizontal exit wall. Within the volume is located a fan which is rotatable in a plane generally parallel to a plane defined by at least one of the horizontal walls. The port is configured to have one inner side located between a center of the exit wall and an outer edge of the exit wall, one outer side located between the inner side and the outer edge of the exit wall, the inner edge being located between the outer side and the exit wall center, and two opposing secant sides connecting respective ends of the outer side to the inner side. The inner side can form either a straight line or a convex line with respect to the exit wall center. By design, the port is configured to take advantage of the natural flow generated by the rotating fan, and thus to be able to more efficiently propel a gas outside of the volume.

In another embodiment, the port of the present invention may be effectively employed as a communication port between two volumes of a multiple chamber gas combustion-powered apparatus. The apparatus includes at least two chambers and a rotatable fan which causes a combustible gas within the apparatus to swirl. A first of the two chambers defines a first volume, and a second chamber defines a second volume. The communication port between the two volumes is constructed and arranged for enabling passage of an ignited gas jet from the first volume to the second volume. The communication port also has a shape corresponding to a speed distribution of the swirling combustible gas, and to the ignited gas jet, seen across the communication port.

The port of the present invention more closely matches the natural speed distribution of gas and materials caused to flow across the port by the rotating fan. By more closely matching this speed distribution, the present invention is able to transmit more gas and material through the port in a shorter time, thereby enabling higher energy combustion when used in a combustion device.

BRIEF DESCRIPTION OF THE DRAWINGS

FIG. 2 illustrates speed distribution of gas swirl in a conventional fan chamber;

FIG. 3 is an oblique view of a plate for a fan chamber utilizing a conventional port;

FIG. 4 is an oblique expanded view of a conventional port, illustrating cross-sectional flow across the port;

DETAILED DESCRIPTION OF THE INVENTION

Figure 5:
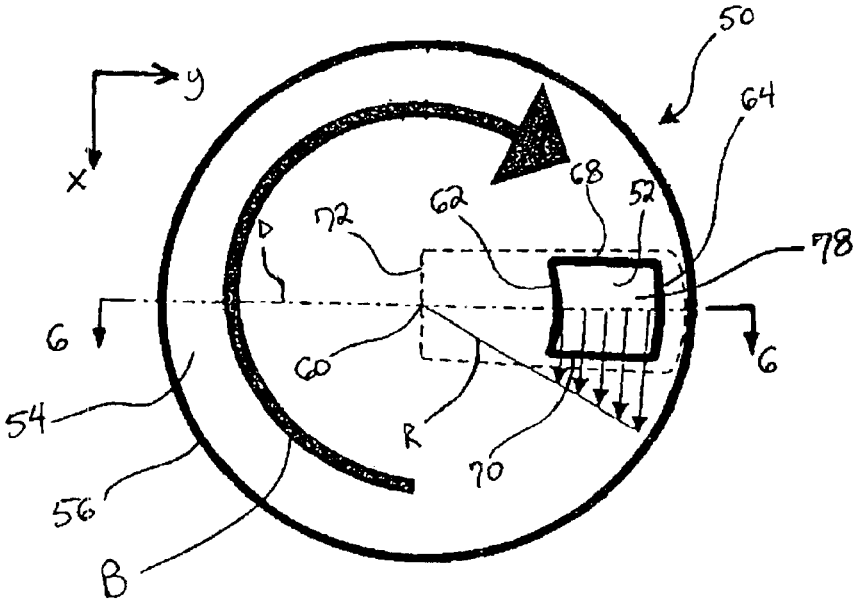
FIG. 5 is an overhead view of one embodiment of the present invention.
Figure 6:
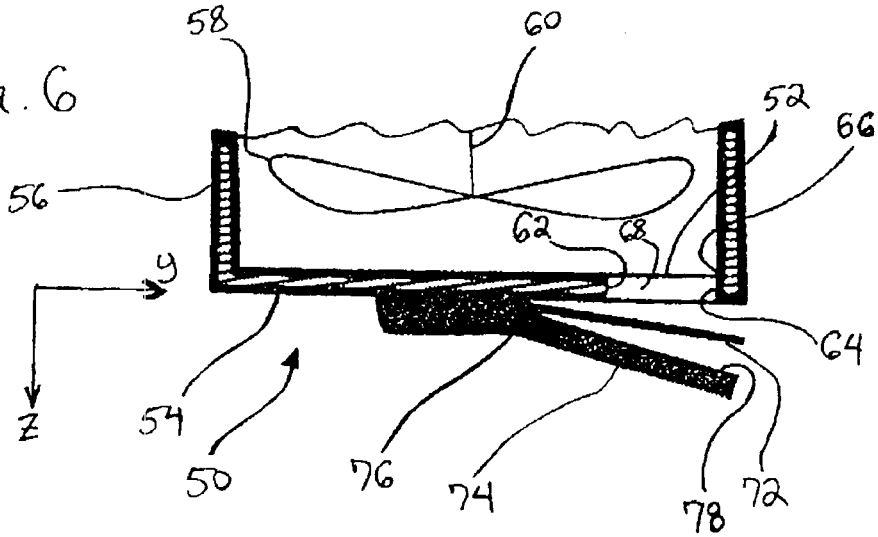
FIG. 6 is vertical schematic sectional view of the embodiment of the present invention illustrated in FIG.5, taken along the line 6—6, and in the direction generally indicated.

Referring now to FIGS. 5 and 6, a fan chamber is generally designated 50, and includes a port 52 located on plate 54. The plate 54 forms a generally horizontal wall of the chamber 50, and conforms to the shape of a generally vertical chamber wall 56 to seal the wall 56 at one end. The plate 54 and the wall 56 are preferably rigid metal bodies, but may also be formed from other strong, rigid, and combustion-resistant materials known in the art. The plate 54 and the wall 56 preferably form a flat disk and cylinder respectively, but one skilled in the art is apprised that many different shapes may be used which allow a swirl of gas within the chamber to be delivered under pressure to an external volume through a port, without departing from the present invention.

A fan 58 in the chamber rotates in a plane generally parallel to the plate 54, and creates a swirl of gas in the direction B. A combustible fuel is fed into the chamber 50 preferably in a low pressure area of the chamber 50 upstream of the fan 58. While one suitable fuel is MAPP gas of the type used in combustion-powered fastener driving tools, the fuel may be any of a number of known combustible fuels practiced in the art. The fuel mixes with air in the chamber 50 to create a combustible gas. The rotating fan 58 rapidly and evenly mixes the fuel with the air in the chamber 50.

An ignition source (not shown) in operational relationship to the chamber 50 is preferably located upstream of the fan 58, and generates a spark which ignites the combustible fuel/air mixture in the chamber 50, whereby a flame front is created that travels from the ignition source downstream of the fan toward the plate 54, which is preferably located downstream of the fan. Pressure from combustion causes a flame to be propelled out of the chamber 50 through the port 52 as a high-energy flame jet. The greater the amount of ignited gas that can travel through the port 52 within a given time, the higher is the energy of the flame jet produced. The present inventor has discovered that the shape of the port 52 can significantly affect how much gas can be transferred through the port within a given time.

After combustion, it is desirable to rapidly scavenge/purge the combustion by-products from the chamber 50. The rotating fan 58 also facilitates a more rapid scavenging of the chamber 50. The present inventor has also discovered that the shape of the port 50 also affects the amount of non-combustible gas that can be scavenged, or otherwise sent out of the chamber 50 through the port 52. In this regard, the present invention has useful applications beyond only use as a port for ignited combustible gases.

Referring now to FIG. 5, as discussed above, the present inventor has discovered that the shape of the port 52 is most useful which can take advantage of the natural speed distribution of the swirl generated by the fan 58. One such preferred shape is that which provides a relatively constant cross-sectional area with regard to the speed distribution of the swirling flow. This preferred shape of the port 52 is based upon a generally rectangular or square shape. Because more materials are expected to flow nearest the outer vertical chamber wall 56 than toward the rotational center 60, the more consistent cross-sectional area over the speed distribution of the gas flow allows for a greater and more stable passage of the materials through the port upon pressure buildup in the chamber 50.

According to the present embodiment, the port 52 is an opening in the plate 54 formed of an inner side 62 and an opposing outer side 64. The inner side 62 is closer to the rotational center 60, and the outer side 64 is closer to the vertical wall 56. In a more preferred embodiment, the outer side 64 is located at the innermost dimension 66 of the outer vertical wall 56, as best seen in FIG. 6, to capture a maximum amount of material flowing at the greatest speed distribution. The inner and outer sides 62, 64 may form generally straight lines, but are more preferably curved to form an arc matching the direction of swirl. In this respect, the curve of the arc should be convex with respect to the rotational center 60. In this embodiment, the inner side 62 has approximately the same length as the outer side 64.

Two opposing secant sides 68, 70 join respective ends of the inner and outer sides 62, 64. The secant sides 68, 70 preferably form generally straight lines along intersecting secants of the circular plate 54. In this embodiment, the secant sides 68, 70 are generally parallel to each other and a diameter D of the circular plate 54, and are spaced on opposite sides of the diameter D at approximately equal distances.

As can best be seen in FIG. 5, the side of the plate 54 facing into the chamber 50 can be viewed as positioned along a two dimensional plane having an x-axis and a y-axis. For such an example, the diameter D of the circular plate 54 defines the y-axis, and the speed distribution of the swirl is shown to move tangentially to the direction B of swirl rotation (in the x-direction, with respect to the diameter D, as shown in FIG. 5). The strength of the speed distribution is thus considered to increase linearly from zero as the distance along the y-axis away from the center of rotation 60 increases, and as a function of a radius R of the plate 54. Accordingly, the entire port 52 should be located between the center 60 and outer vertical wall 56. In other words, no portion of the port 52 should cross or overlap the center 60.

Figure 1:
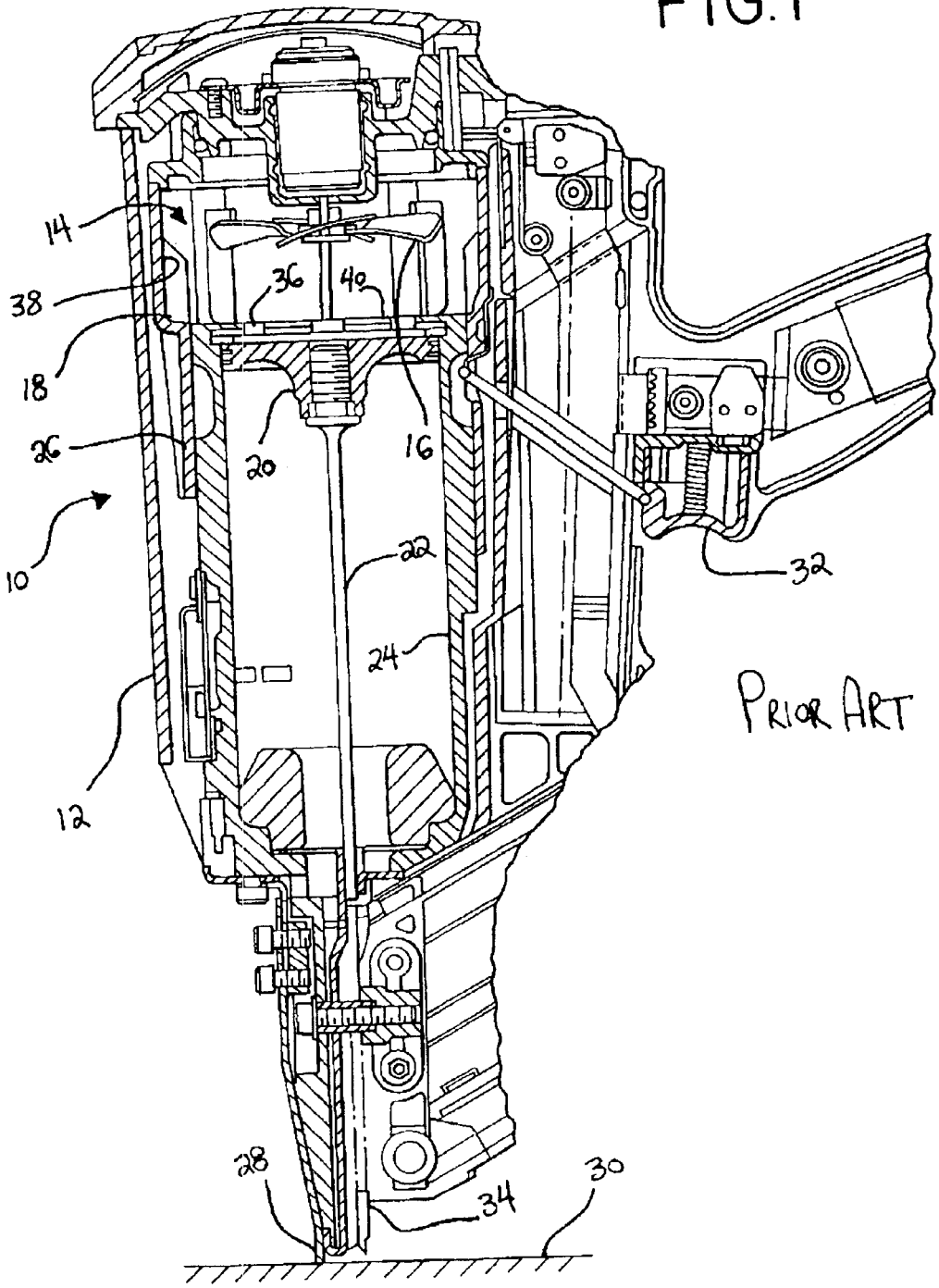
FIG. 1 is a schematic view of a conventional tool utilizing a fan chamber.

This preferred embodiment of the present invention realizes several advantages over the circular ports known in the art. Because the cross-sectional area of the port 52 more closely matches the natural flow created by the fan 58, the flow across the port is steadier, with less disturbance, thereby yielding a broader range of stability of flow through the port 52, which results in a significantly lower likelihood of flame quenching. A greater amount of gas is thus transferred more rapidly through the port 52, which in turn also increases the maximum combustion energy output. These advantages of the present invention are realized whether the port 52 is utilized in a single chamber system for combustion, as illustrated in FIG. 1, or in a multiple volume system. These advantages may also be realized when the port of the present invention is used in conjunction with intake ports (not shown) and/or recirculation ports (not shown) located along the continuous vertical wall 56.

Referring now to FIG. 6, as discussed above, multiple volume combustion systems, and some single chamber systems, can employ valves, valve limiters, and shrouds in conjunction with a port through which an ignited gas is propelled. A valve 72 and a valve limiter 74 are employed over the port 52 according to a preferred embodiment of the present invention. Preferably a reed valve, as is known in the art, the valve 72 remains normally closed to prevent back flow of pressure from the outer volume into the chamber 56. Although a reed valve is preferred, the present inventor also contemplates that other valves known in the art may be employed according to this embodiment of the present invention, without departing from the invention. The limiter 74 may be formed of any solid, combustion-resistant material known in the art.

As discussed above, the speed distribution of the flow across the port 52, in the x-direction, increases as the distance increases from the center 60 in the y-direction. The present inventor has also discovered that the swirl of the fan 58 causes distribution of material through the port 52, in the z-direction, to increase as the distance increases from the center 60. Given this relationship, a reed valve is preferred as the valve 72 because it can be positioned to increasingly open, in a hinging or ramping effect, toward the outer side 64 of the port 52, as best seen in FIG. 6.

The valve 72 and the limiter 74 should therefore be preferably located such that a resulting y-z axis cross-sectional area can also conform to the natural speed distribution of the gas through the port as generated by the fan. Accordingly, the valve 72 and limiter 74 should preferably be flat, and located along a radial line (not shown), which increases in the z-direction from the center 60 to the outer wall 56. A pivot/hinge 76 of the valve 72 is preferably located in a region of the plate 54 near the center 60, and pivots downward so that a gap between an inclined portion of the limiter 74 (or opened valve 72) and the port 52 is greater by the outer wall 56 and smaller nearer the center 60. An inner surface 78 of the limiter 74 facing the port 52 should then most preferably conform to a shape of a generally planar ramp.

This preferred valve/limiter configuration best conforms to the cross-sectional speed distribution of the gas flow swirling through the port 52, from a "valve closed" position, when the valve 72 seals the port 52 shut, to a "valve fully open" position, when the valve 72 is in fill contact with the limiter 74. Each intermediate position of the valve 72 between these two positions further enables increase of airflow in the z-direction approaching the outer wall 56. Another advantage to locating the port 52 away from the center 60 is that a region of the plate 54 surrounding the center 60 can remain solid and thus accommodate mounting of the limiter 74 and hinge/pivot 76 of the valve 72. The valve 72 and limiter 74 are preferably attached to the plate 54 by screws, but may also be attached by other mounting means known in the art.

This simplified valve and limiter configuration also allows the limiter 74 to shield the port 52 from the surrounding environment, thereby desirably eliminating the need for an additional shroud which, as discussed above, is used to create a restrictive path for the flow to increase combustion energy output. In this preferred configuration, the valve 72 and the limiter 74 are capable of providing the sufficient restrictive path realized normally in conjunction with use of an additional shroud, but while still allowing an improved transfer of gas from the fan chamber to an outer volume. Accordingly, the present invention is able to avoid having to face much of the known tradeoff between high-energy restrictive paths, and the proper gas and flame transfer that are experienced by existing port and valve configurations.

This preferred configuration also advantageously in three dimensions increases the speed distribution benefits realized from the two-dimensional distribution configuration illustrated in FIG. 5. Additionally, while the present valve configuration is described in relation to use for a port of a combustion chamber, one skilled in the art will be aware that the port and valve configuration of the present invention can also be used in conjunction with a different chamber in a multiple volume system, one which is located downstream of a chamber containing a rotating fan, or even in a system which does not require combustion of the gas transferred through a port.

Figure 7:
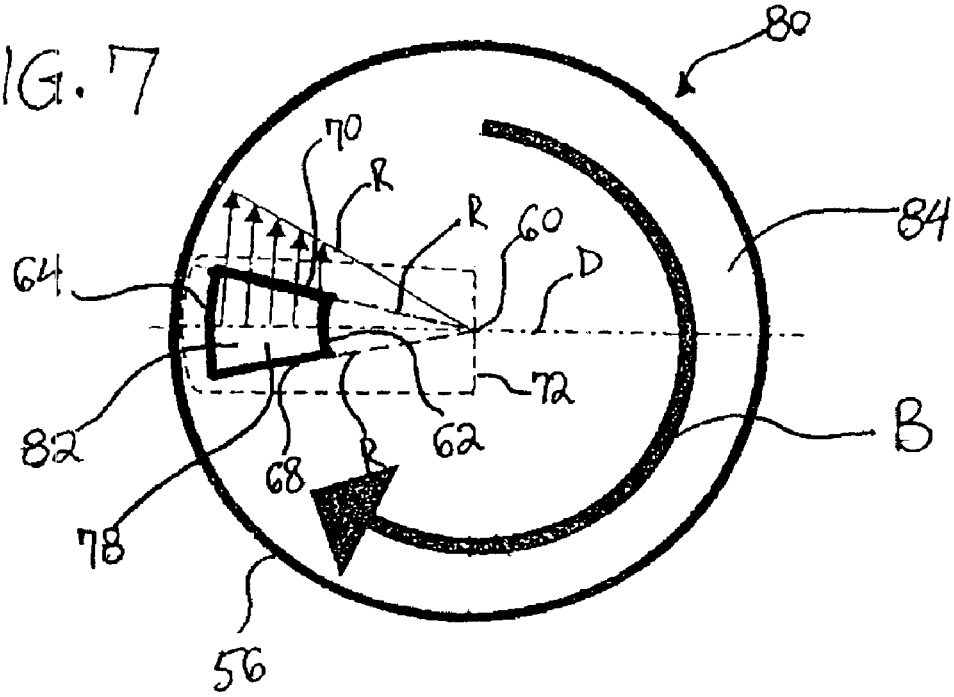
FIG. 7 is an overhead view of another embodiment of the present invention.

Referring now to FIG. 7, a fan chamber is generally designated 80, and incorporates many of the features of the chamber 50, which features are given the same numerical designations for convenience. The chamber 80 features a port 82 according to another preferred embodiment.

The port 82 is similar to the port 52, except for the configuration of the secant sides 68 and 70. In this preferred embodiment, the secant sides 68 and 70 are no longer parallel to each other, or the diameter D, but are now located along the radii R of the plate 84. By positioning the secant sides 68, 70 along radii R of the plate 84, the secant sides 68, 70 will then automatically become equally spaced on either side of the diameter D. This embodiment has the widest opening of the port 82 nearest, or preferably at, the vertical chamber wall 56, with a progressively narrower opening approaching the rotational center 60. This configuration of the port 82 resembles a portion of a pie wedge, and also advantageously enables the port 82 to most closely conform to the natural flow of gas across the port caused by the swirl from the fan 58.

The present inventor has discovered that this embodiment is particularly advantageous when no valve or valve limiter is used in the restrictive path, or when a valve is used which opens at a consistent distance across the port 82 opening (parallel to the port 82 and plate 84 in the z-direction). The speed distribution of the airflow through the port 82 can be entirely approximated by the shape of the port in the x-y plane only. Those skilled in the art will be aware that different combinations of port and valve configurations can also approximate the speed distribution of the three-dimensional airflow through and across the port 82, but without departing from the present invention.

Although it is preferred to have both secant sides 68, 70 formed along the radii R in the present embodiment, the present inventor contemplates that one of the two opposing sides may also be formed parallel to the diameter D, or even parallel to the other opposing side formed along the radius R. The preferred configuration, however, is that the secant side 68 be at least as distant from the secant side 70 where they meet the outer side 64 as where they meet inner side 62. The secant side 68 is even more preferably farther from secant side 70 at the outer side 64 than the inner side 62.

Accordingly, the ports of the embodiments discussed above better incorporate the natural swirl generated by fan rotation in a fan chamber, and can therefore better permit a greater flow of gas through a port in a shorter amount of time, which can thus increase a maximum energy output from the chamber. This improved configuration allows a broader range of stability for the flow through the port, which results in a significantly lower risk of premature flame quenching when the gas is combustible and ignited. The present invention also allows for a more simplified valve and restrictive path design to cover the port, which would, as discussed above, require fewer parts.

Those skilled in the art are further apprised that ports which can be used for combustion apparatuses, such as the present invention, may also be effectively employed in other devices which utilize a fan to rapidly transfer a gas from one volume to another, devices which drive a piston, or devices that may be powered by combustion apparatus in general. While particular embodiments of the combustion mechanism of the present invention have been shown and described, it will also be appreciated by those skilled in the art that changes and modifications may be made thereto without departing from the invention in its broader aspects, and as set forth in the following claims.

What is claimed is:

1. A fan chamber, comprising:

a generally horizontal base wall;

a generally horizontal exit wall;

a continuous vertical wall connecting said base wall to said exit wall; and a fan inside the chamber, and being rotatable within a plane generally parallel to at least one of said base and exit walls;

a port located on said horizontal exit wall, and having an inner side, an outer side opposed to said inner side, and two opposing sides joining said inner side to said outer side;

said inner side forming a straight or convex line with respect to a central region of said horizontal exit wall; and said outer side having a length equal to or greater than a length of said inner side.

2. The fan chamber as claimed in claim 1, further comprising a valve, said valve disposed to cover said port outside of the chamber and remaining normally closed, but opening when a pressure inside of the chamber is greater than a pressure outside of the chamber.

3. The fan chamber as claimed in claim 2, further comprising a valve limiter disposed outside of the chamber to cover said valve and said port.

4. The fan chamber as claimed in claim 3, wherein one end of said valve limiter is mounted to said central region of said horizontal exit wall, and another end of said valve limiter opens away from said exit wall nearest said vertical wall.

5. The fan chamber as claimed in claim 4, wherein a shape of said valve limiter forms a ramp, and an angle of said ramp corresponds to a speed distribution of a gas caused to exit the chamber through said port by said rotatable fan.

6. The fan chamber as claimed in claim 1, further comprising at least one of an intake opening and a recirculation opening located along said vertical wall.

* * * * *